US007857022B2

(12) United States Patent
Kräml

(10) Patent No.: US 7,857,022 B2
(45) Date of Patent: Dec. 28, 2010

(54) PROTECTIVE CASE FOR CREDIT CARD OR THE LIKE

(75) Inventor: Erich Johann Kräml, Monterfil (FR)

(73) Assignee: Erich Kräml Et Associes (FR)

( * ) Notice: Subject to any disclaimer, the term of this patent is extended or adjusted under 35 U.S.C. 154(b) by 19 days.

(21) Appl. No.: 12/085,042

(22) PCT Filed: Nov. 10, 2006

(86) PCT No.: PCT/EP2006/068362

§ 371 (c)(1),
(2), (4) Date: May 13, 2008

(87) PCT Pub. No.: WO2007/057364

PCT Pub. Date: May 24, 2007

(65) Prior Publication Data

US 2010/0012239 A1 Jan. 21, 2010

(30) Foreign Application Priority Data

Nov. 15, 2005 (FR) ..... 05 11583

(51) Int. Cl.
*A45C 11/18* (2006.01)

(52) U.S. Cl. ..... 150/149; 150/147; 206/37; 206/38; 206/39.4

(58) Field of Classification Search ..... 150/147, 150/149; 206/37, 38, 39, 39.4, 449, 37.4; 221/446
See application file for complete search history.

(56) References Cited

U.S. PATENT DOCUMENTS 493,473 A * 3/1893 Borgstrom ..... 206/39
1,244,338 A * 10/1917 Johnson ..... 221/232
4,450,955 A * 5/1984 Featherston ..... 206/39.6
4,792,058 A * 12/1988 Parker ..... 221/232
5,337,813 A * 8/1994 Ritter ..... 150/147
5,417,328 A 5/1995 Ritter
5,592,767 A * 1/1997 Treske ..... 40/649
5,894,954 A * 4/1999 Horian ..... 221/33
6,050,014 A * 4/2000 Ohlson ..... 40/649
2002/0056652 A1 5/2002 Kawamura et al.

FOREIGN PATENT DOCUMENTS

DE 94 13 668.8 U1 11/1994
FR 2 716 093 A1 8/1995

* cited by examiner

*Primary Examiner*—Sue A Weaver
(74) *Attorney, Agent, or Firm*—Lerner, David, Littenberg, Krumholz & Mentlik, LLP

(57) ABSTRACT

This case is made up of a bottom element (1) and of a lid element (4), both comprising a small rectangular plate (2; 5), the two plates being superimposed in such a way as to define a slim space into which the card (C) can be inserted, this space being open along one short side—termed "front side"—and closed along the other short side—termed "rear side". The case is noteworthy in that the lid element (4) comprises a pair of longitudinal rims (3) exhibiting guide slots for the longitudinal edges of the small plate (5) of the lid element (4), the latter also being provided, on the rear side, with a transverse rim (50) which acts as an end stop for the rear transverse edge of the card so that it is possible to slide the lid element (4) and the card (C) that it covers, with one another, in the longitudinal direction, towards the front side, over a determined length of travel, thus making it easier to extract the card.

11 Claims, 5 Drawing Sheets

PROTECTIVE CASE FOR CREDIT CARD OR THE LIKE

CROSS-REFERENCE TO RELATED APPLICATIONS

The present application is a national phase entry under 35 U.S.C. §371 of International Application No. PCT/EP2006/068362 filed Nov. 10, 2006, published in French, which claims priority from French Application No. 0511583 filed Nov. 15, 2005, all of which are incorporated herein by reference.

FIELD OF THE INVENTION

This present invention relates to a protective case for a credit card or similar. In particular, the card in question can be a card equipped with a magnetic strip, an electronic chip, a communication system of the Radio Frequency Identification (RFID) type, and/or miscellaneous other components. The said card can, in particular, be used for payment, cash withdrawal, or any other transaction, can provide access to a public service, and/or can be used for identification of its owner, though these applications are in no way limiting.

BACKGROUND OF THE INVENTION

A credit card or other similar type card is semi-rigid, very thin, and has standardized dimensions. The card is rectangular in shape, with rounded corners, with the short side being 54 mm and the long side being 85 mm.

A traditional protective case for such a card is a flat, rectangular box, whose dimensions are slightly larger than those of the card. The case is generally made of a plastic material, and is composed of a bottom element and a lid element, both flat and attached to each other. The card can be inserted between these two elements by passage through an open end, in the form of a slot, of the case.

Generally, the lid element has quite a large opening in it, which allows the user to push the card, by means of his thumb, in order to slide lengthwise so as to extract it from the case. Insertion of the card into the case is effected quite simply by inserting it into the slot and then pushing it into the case. These operations are not very convenient, since they involve relative rubbing of the two faces of the card against the internal faces of the case. In the long term, this repeated rubbing can give rise to unwanted wear on the card, and in particular of the parts in relief included on it, especially the embossed printing and/or the magnetic/electronic components.

Through document EP-0 580 890, we are also familiar with a case of the aforementioned type which is equipped with a system to facilitate the extraction of the card. To this end, the lid element of the case is equipped with a small flat bar that is guided in longitudinal translation in the lid element, so that it is able to slide in it. This bar includes a control cursor, which projects from the top of the lid element, and whose travel amplitude in the longitudinal direction is determined by the length of a window created in the lid element. This bar is equipped at its rear side, which is located inside the case, with a claw or a cleat that comes up against the rear transverse edge of the card (the edge that corresponds to one of its small sides). Thus, by moving the cursor to the front, meaning in the direction of the case slot, it is possible to push the card partially out of the case, thereby facilitating its removal, since the card can be gripped more easily when it is partially out of the case.

This relatively sophisticated arrangement is quite expensive to implement, and ill-suited to mass production. Furthermore, the rubbing problem mentioned above is not solved, since both the top face of the card and its bottom face rub against the internal faces of the case during the movements of the bar. It is only the part of the card, of very low width, located under the window and under the control bar, that accompany the bar in its movement and that is therefore not exposed to such rubbing action.

Another drawback of this known device results from the fact that the front section of the flat bar projects below the level of the lid element inside the case, thus constituting an obstacle that hinders the insertion of the card. Certain parts relief, in particular, the printing present on the top of the card, can catch on this edge and can be damaged or worn prematurely.

SUMMARY OF THE INVENTION

This present invention aims to overcome these difficulties by proposing a case of the type described above which, while being of simple design and inexpensive to make, allows easy manipulation of the card both in extraction and insertion, while also very considerably limiting the risks of damage or of premature wearing of the card.

Another objective of the invention, according to the various optional embodiments possible, is to propose a protective case for a credit card that is of a versatile character, as will be seen later. As indicated above, the protective case that is the subject of this present intention, intended to receive a credit card or a similar card, is composed of a bottom element and a lid element, both including a rectangular plate, the two plates being superimposed so as to form a narrow space into which the card can be inserted, this space being open on one small side—called the "front side"—and closed on the other small side—the "rear side"—, the said bottom element including a pair of longitudinal rims with guidance grooves (forming slides) for the longitudinal edges of the plate of the lid element. This prior art is illustrated in documents FR-A-2 716 093 and DE-U-9 413 668.

According to the invention, the lid element is equipped, at the rear side, with a transverse rim used as a stop for the rear transverse edge of the card, so that it is possible to jointly slide the lid element and the card that it covers, in the longitudinal direction, toward the front side, over a limited distance, whose amplitude is somewhat less than the length of the card. In addition, according to a certain number of advantageous, non-limiting characteristics of the invention:

The rims have a cross section that is substantially a C-shape, whose interior forms a space to receive one longitudinal edge of the plate of the lid element;

- the guidance grooves of the longitudinal edges of the plate include recessed sections in which projecting tabs located on the sides of the plate fit so as to limit the travel amplitude of this plate to the exterior;
- the said tabs are elastically deformable, which allows them to be inserted into the assembly, into the said sections of recessed grooving, and to be removed when so required:
- the plate making up the lid element is slightly corrugated in the transverse direction, so that its wall is located slightly away from the card in its central zone and in two lateral zones.
- on its front side, the said plate has a central cut-out.

In a particularly useful embodiment of the invention, the case is optionally equipped with a closure bar adapted to be clipped into the front edge of the bottom element in order to secure the lid element there, and the card contained in the case. Advantageously, the said bar has a central cut-out that, together with the front edge of the card, forms an opening that allows the passage of an attachment device of the case to a garment. Thus, in this embodiment, it is possible to attach the case to a garment easily, so that it acts as a badge, the card in this case being a card for identification of its owner for example.

In another possible embodiment of the case, the latter is optionally equipped with a fixed lid element that includes the lateral locating spigots that allow it to be attached to the bottom element. In this case, we have an arrangement that is similar to that of a traditional case, which can be useful in certain conditions of use of the card. Advantageously, when the two options are available at once, the bottom element has locking cavities in which it is possible to selectively engage either clipping tabs on the said closure bar, or the lateral locating spigots on the fixed lid element. Thus, with only a single bottom element, two types of lid element, and the closure bar, one is in possession of a kit that allows the case to be given the desired configuration according to the type of card with which one is working.

BRIEF DESCRIPTION OF THE DRAWINGS

Other characteristics and advantages of the invention will appear from the description that follows, and from the appended drawings that represent preferred embodiments of it, though for guidance purposes only.

In these drawings:

FIG. 1 is a view in perspective of this element while FIGS. 4, 3 and 5 are views from above, the front and the side of the bottom element respective.

FIG. 2 is a view in longitudinal section corresponding to the plane referenced II-II in FIG. 4.

FIG. 6 is a view perspective of the element that is represented in reverse (top face turned to face downward).

FIGS. 8 and 9 are respectively front and side views of the element, while FIG. 7 is a view in longitudinal section on the plane referenced VII-VII in FIG. 8.

DETAILED DESCRIPTION

Figure 1:
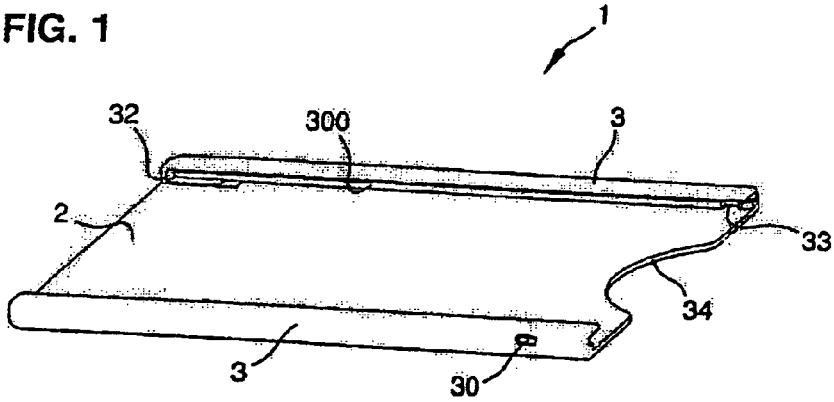
FIGS. 1 to 5 represent the bottom element of the case.
Figure 2:
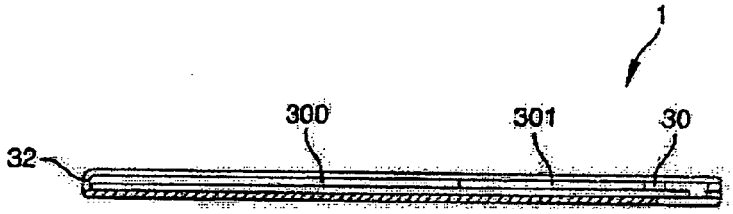
Figure 3:
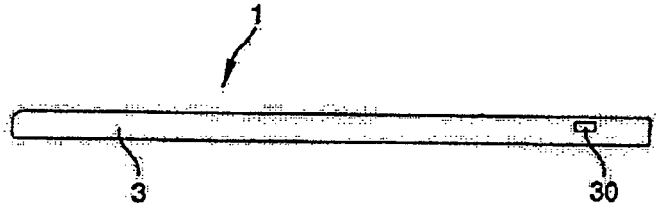
Figure 5:
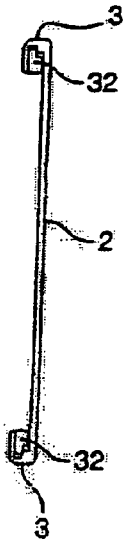
Figure 4:
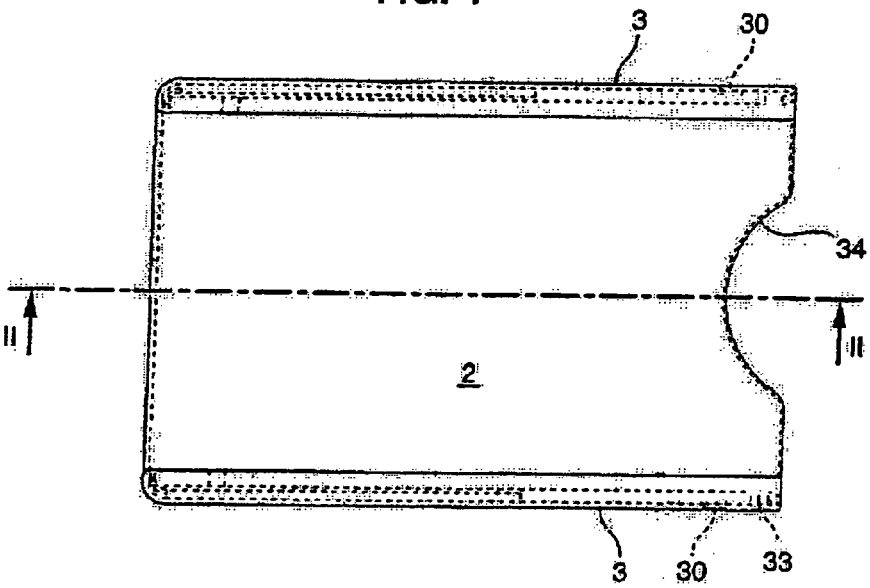

The bottom element 1 represented in FIGS. 1 to 5 includes a flat bottom 2 of substantially rectangular shape, whose dimensions are a little larger than those of the card. The bottom plate 2, which is substantially flat, has longitudinal lateral edges 3 that are folded to form slides. These have a section that is approximately in C-shape. The openings of the two "C"s are arranged to face each other.

At one of their ends, which corresponds to the left in FIGS. 1 to 4, the slides are closed by a rim 32 on one side, which we will call the rear side of the case and of the card. The slides have the reference 300, and on the front side, they are traversed by small transverse orifices 30 whose function will be explained later. It will also be noted that the front edge of the case has a central cut-out 34. As can be seen in particular in FIGS. 5 and 15, the slide 300 is slightly offset upwards (to the left if one considers the view of FIG. 5) in relation to the plane of the plate 2, which constitutes the bottom wall of the case.

In fact, as will be seen later, the slides 300 are intended to be used for the guidance in axial translation of the lid element, since the latter must be positioned at a certain distance from the wall 2, so as to create a space or interstice, whose height corresponds to the thickness of the card. In addition, at their front part, the slides 300 have a section 301 that is deeper than the remainder of the slide. This increased depth results from a reduction in the thickness of the rim 3 facing this section, as can be seen more particularly FIGS. 10A to 10C.

The lid element 4 shown in FIGS. 6 to 9 essentially includes a thin plate 5 that is equipped on the side of its rear edge with a rim 50 folded at right angles. Its front edge equipped with a central cut-out 51, and is traversed in a median zone by a small opening 52. The plate 5 is equipped with a pair of elastic tabs 6 located symmetrically on its longitudinal edges, approximately two thirds the length of the card toward the front (meaning toward the side opposite to the near rim 50).

Figure 9:
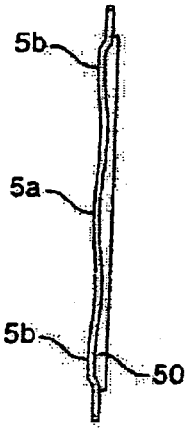
Figure 8:
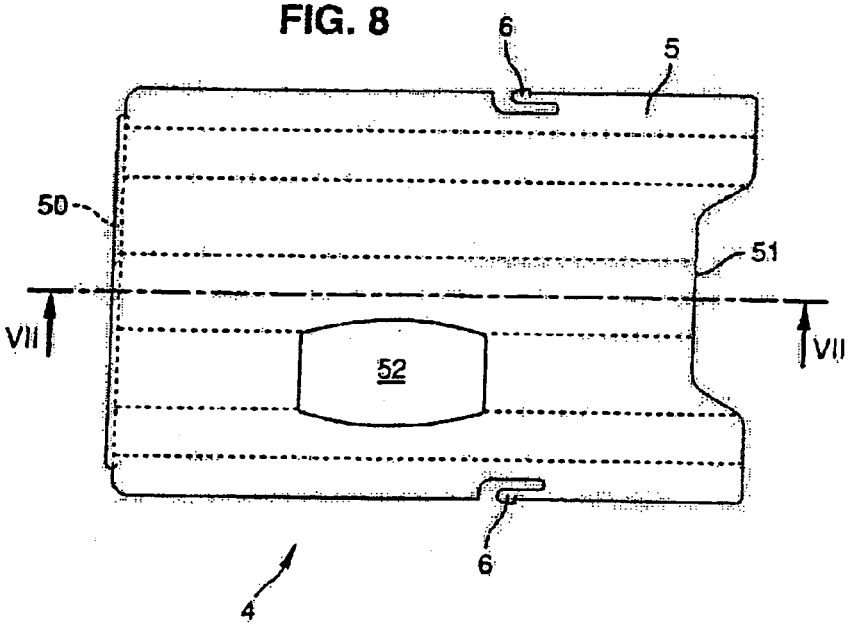
Figure 14:
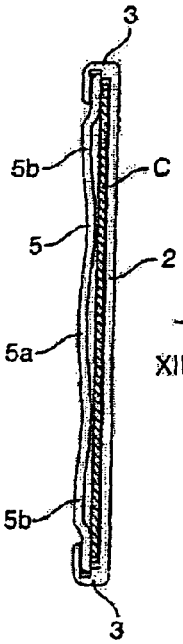
FIG. 14 is a side view of the case in cross section.

As can be seen particularly in FIGS. 9 and 14, the lateral longitudinal edges of the plate 5 are flat, while the remainder of the plate is slightly corrugated in the transverse direction, so as to present a central wave 5*a* and a pair of lateral waves 5*b*. These "waves" are corrugations of very low amplitude. In order to assemble the lid element 4 to the bottom element 1, it is slipped into the slides 3, in the manner of a drawer, its rim 50 being directed downward, i.e., toward the bottom wall 2. Chamfered edges provided on the tabs 6 allow insertion of the lid element by translation into the slides 3. Once it arrives at the level of the recessed sections 301, the elastic tabs 6 expand and are trapped there.

The lid element can then move longitudinally in the slides for a limited distance, whose amplitude depends on the length of the recessed sections 301. Dismantling nevertheless remains possible, through the presence of slots 30 in the rims 3, which allow the passage of a tool such as the blade of a small screwdriver allows the elastic tabs 6 to be pushed inwards in order to allow the freeing of these tabs.

It will be observed that the structure of this case is such that when a card C is inserted in the case, between the plates 2 and 5, it is completely covered by the latter. This configuration is therefore very different from the one that is the subject of the aforementioned document EP-0 580 890, in which it is only over a very limited width that the card is covered by a mobile element, in this case the flat bar provided in this known case.

Figure 10A:
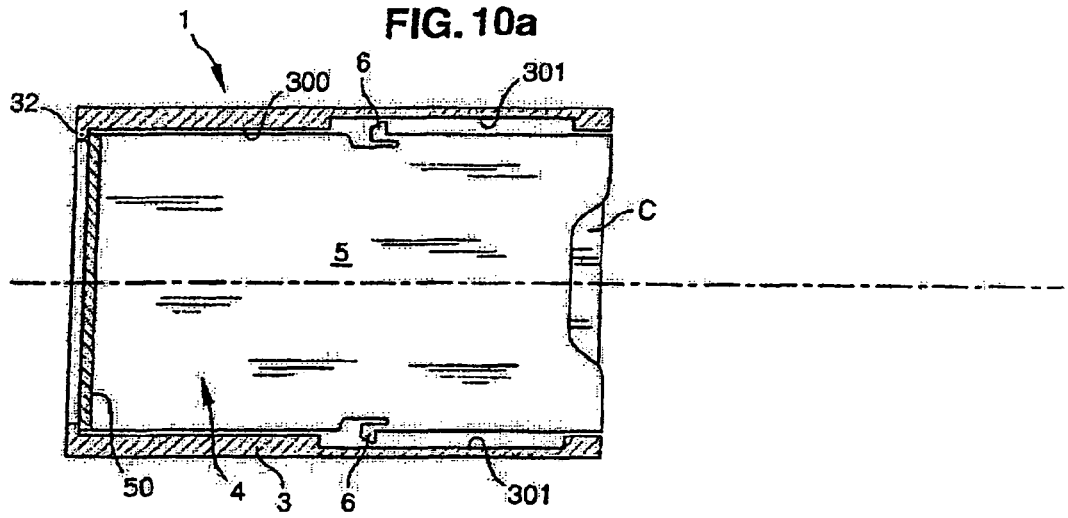
FIGS. 10A, 10B and 10C are diagrams illustrating the principle of operation of the case during removal of the card.
Figure 10B:
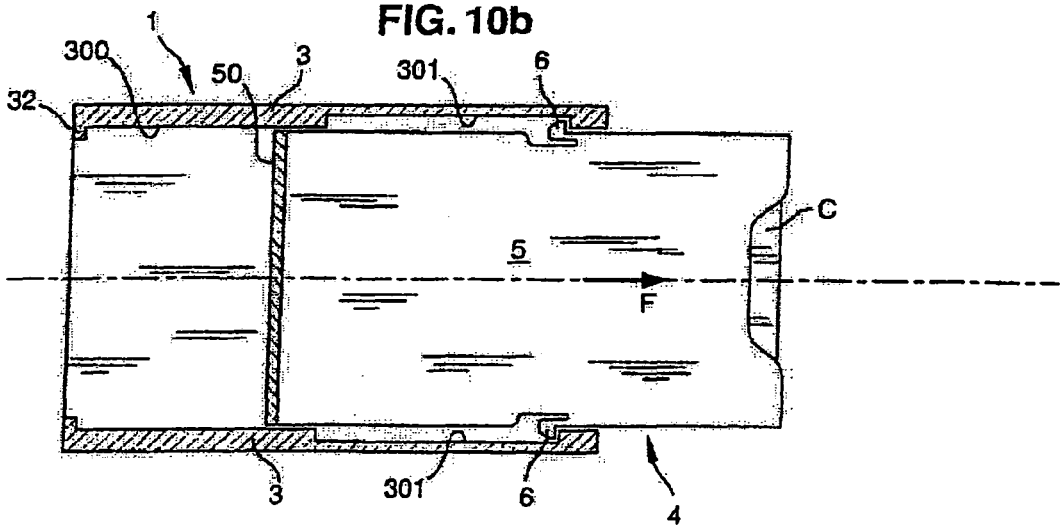
Figure 10C:
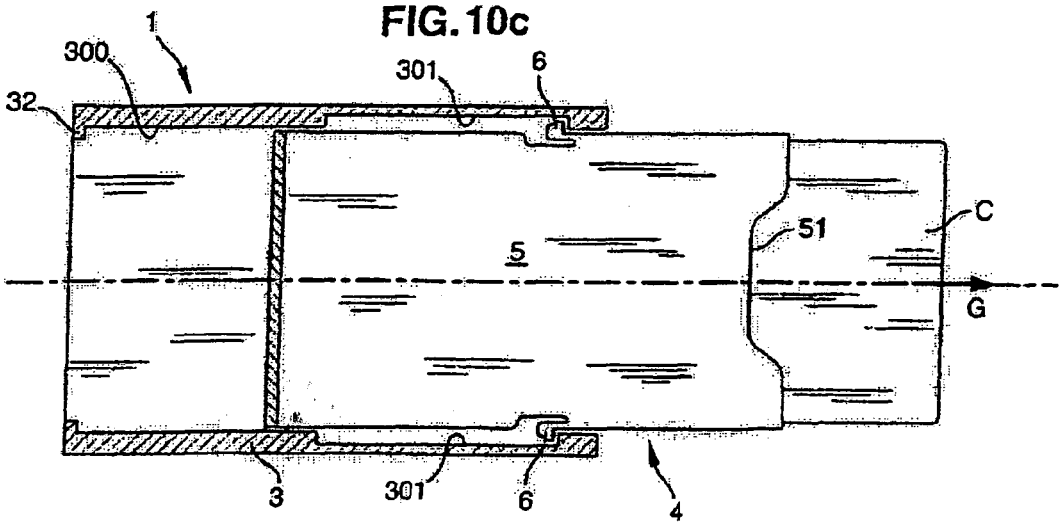

With reference to FIGS. 10A to 10C, we will now explain the manner in which the extraction of a card C is effected from inside the case. FIG. 10A represents the storage position, which the lid element is completely inserted into the bottom element. It can be seen that, in this position, the elastic tabs 6 are located close to the rear ends of the recessed sections of wall 301 that receive them.

When the user wishes to withdraw the card out of the case, he presses lightly using one finger, generally by means of the thumb, on the lid element, and more precisely on the plate 5 constituting this element. He causes it to slide, in the manner of a drawer, in the longitudinal direction, as indicated by arrow F in FIG. 10B. Given that the rear transverse edge of the card is bearing up against the claw (folded rear rim) 50 of the lid element, the card is driven in this sliding motion. During this phase therefore, there is no relative movement of the card in relation to the lid element. When the elastic tabs 6 arrive up against the front part of the recessed sections 301, then movement of the element 5 is stopped. This distance is chosen, for example, to be approximately half the length of the card.

In a second step, in order to remove the card C, the user grasps the central zone of the front edge of the card, which is possible due to the presence of the aforementioned cut-outs 51 and 34, and then withdraws it axially as indicated by arrow G. During this movement, the rubbing between the top face of the card C and the bottom of the plate 5 of the lid element is relatively small, because the card is located largely in an overhanging position, and is practically no longer supported by its bottom face.

Figure 15:
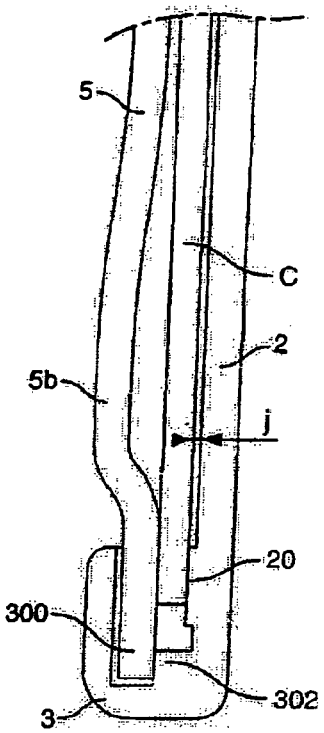
FIG. 15 is a detailed view of a lateral edge of the case.
Figure 16:
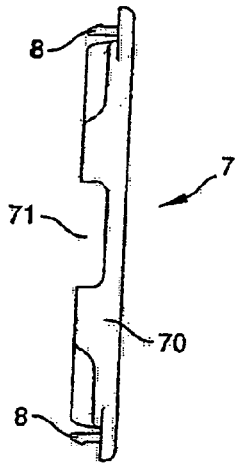
FIG. 16 is a view from above of the closure bar.
Figure 17:
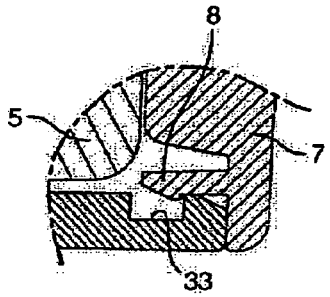
FIG. 17 is a detailed view in section, which illustrates the clipping principle of the closure bar in the case.
Figure 18:
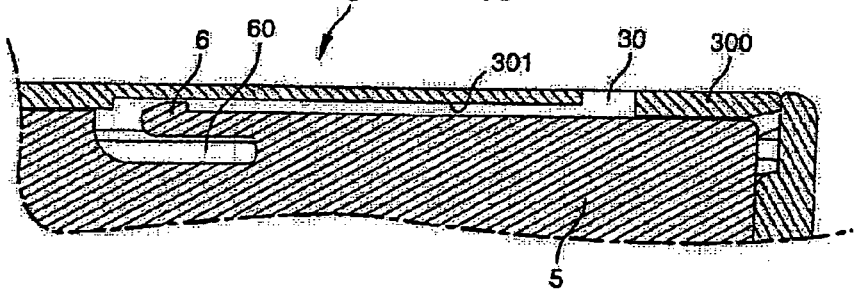
FIG. 18 is a view in plan and in section of a lateral edge of the case.

This extraction, symbolized by arrow G in FIG. 10C, can also be achieved by pushing it with the thumb through the aforementioned opening 52. The corrugations 5*a* and 5*b* in the plate 5, already mentioned earlier, are arranged so that they correspond to printing or components that are liable to be embossed and stand proud on the top face of the card. Thus, even in the final extraction phase, corresponding to the FIG. 10C, in which there exists a relative sliding of the card and the lid element, the risks of damage and/or of unwanted wear remain limited. The detailed view FIG. 15 shows how the lateral guidance of the plate 5 is effected in the slides 300 of the bottom element.

As mentioned earlier, one can see that the bottom of the slide is stepped, with the border zone of the plate 5 remaining against a thickened border zone 302 which, together with the bottom 300 of the groove, forms a stepped configuration. Thus, the card C is not compressed between the plate 5 and the wall 2 of the bottom element. In addition, the said bottom wall is advantageously equipped on its inner face (or top face) close to each longitudinal edge, with a thickened edging strip 20 against which the corresponding edge of the card C rests. Thus a very small reference play j is created, as shown FIG. 15, which prevents rubbing of almost the whole bottom face of the card against the bottom element. Thus only the longitudinal lateral edges of the card, generally free of any elements in relief, rub against the bottom element.

Figure 11:
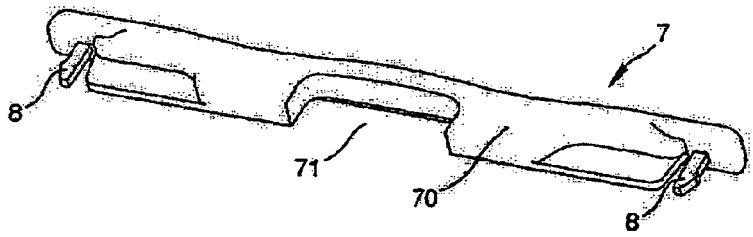
FIG. 11 is a view in perspective of a closure bar that can be fitted to this case.
Figure 12:
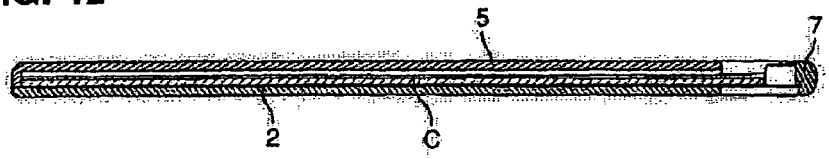
FIG. 12 is a view in longitudinal section of this case, where the section plane is referenced XII-XII in FIG. 13.

With reference to FIG. 11, and also to FIGS. 12-13 and 16-18, we will now describe the structure and the function of an element that can be included as an option, namely a closure bar, referenced 7. As shown FIG. 11, this is an extension piece 70, equipped at its ends with a pair of clipping hooks 8 and with a cut-out 71 in its central part. This bar 7 is arranged so that it can be inserted into the slot that constitutes the open end of the case, once the lid and bottom elements have been assembled to each other. To this end, the internal faces of the lateral rims 3 of the bottom element are equipped with a pair of cavities that are located a small distance from the opening in the case. One of these cavities, referenced 33, is represented in the detailed view of FIG. 17.

The hooks 8 are carried by elastic tabs, and have an entry chamfer which allows them to be click fitted by simple axial pressure into the opening of the case. It can thus be seen movement of the lid element, as well as that of the card contained in the case, are prevented. The use of this bar is useful particular when the card is an identity badge, that can be read or decrypted without having to be removed from the case. This is particularly the case of the identification badges that can be used in certain companies in order that only certain members of staff can enter certain areas.

Figure 13:
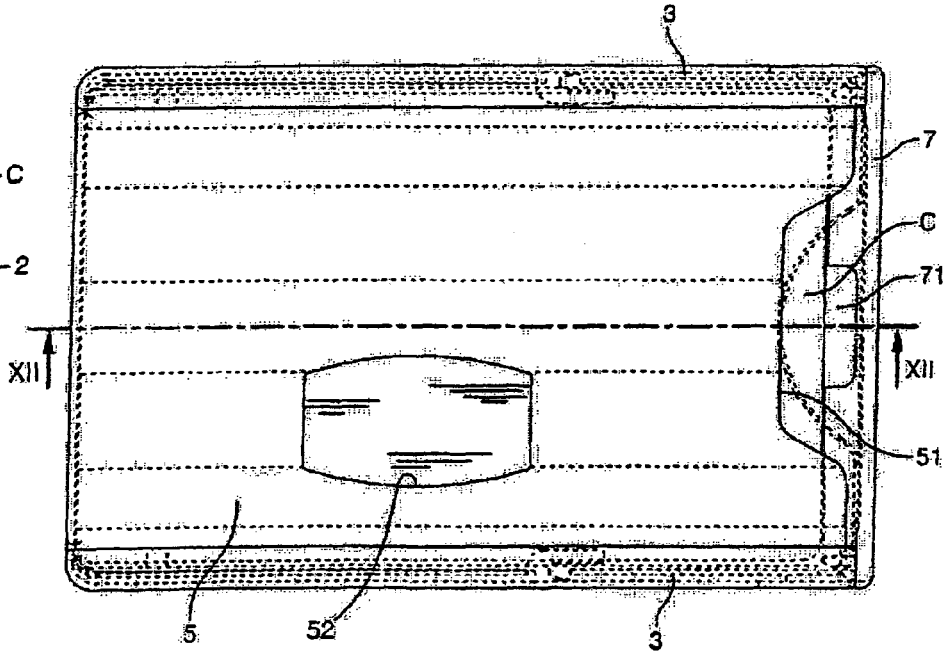
FIG. 13 is a view of the case from above, into which a credit card has been inserted, this case being equipped with the closure bar of FIG. 11.

By observing FIG. 13, it can be seen that the presence of the cut-out 71 and the front edge of the card C that is located in the case forms a small cavity that allows the passage of a tie, such as a flexible ribbon in a plastic material, suitable for being attached to a clip that can itself then be attached to a garment.

Figure 6:
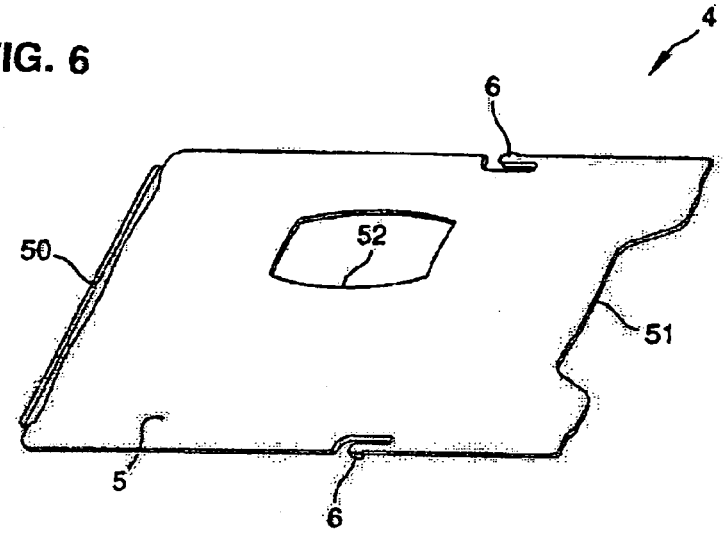
FIGS. 6 to 8 represent a lid element.
Figure 7:
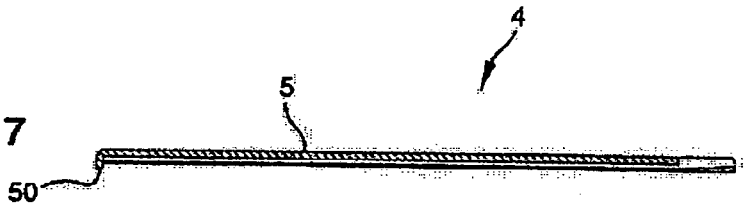
Figure 19:
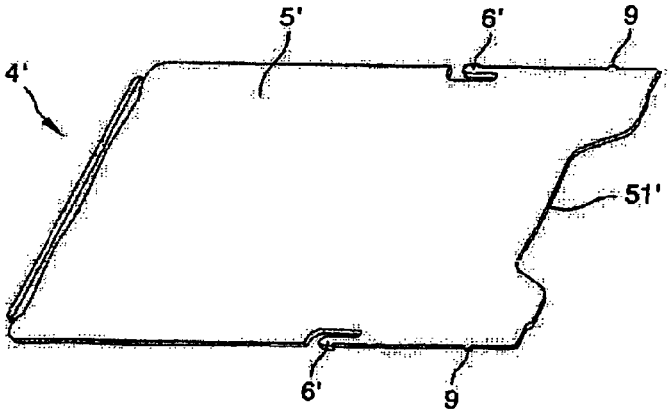
FIG. 19 represents, perspectively, a variant of the lid element, which can be fitted optionally instead of that of FIG. 6.

The variant of the lid element represented in FIG. 19 is quite similar to that of FIG. 6, and this is why the same reference numbers have been used to indicate similar elements, though these numbers are associated with an apostrophe (') in this case. It will be seen that this lid element is equipped with a pair of lateral locating spigots 9, which project laterally and transversally to the outside. These locating spigots are located close to the front end of the lid element 4', and are positioned so that they lie opposite to the cavities 33 mentioned earlier, when the bar 7 not being in position, the lid element 4' is inserted into the bottom element 1. These locating spigots 9 then mutually lock these two elements together, which then constitute a case of the traditional type whose bottom and lid are attached to each other This arrangement can be useful in certain cases where it is necessary to remove the card from its case from time to time, but not frequently.

It can thus be understood that a person with a bottom element 1, a sliding lid element 4, a closure bar 7 and a fixed lid element 4', is possession of a kit that allows him to adapt the configuration of the case to the use to which he wishes to put his card. The bottom of lid and the closure bar elements are made of a plastic material that is traditionally used in this field, where this material can be transparent, translucent or opaque as required.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A protective case for a credit card, comprising:

a bottom element and a lid element, wherein the bottom element and the lid element each include a substantially rectangular plate, the two plates being configured to be superimposed relative to each other so as to define a narrow space, the narrow space being open on a front side and configured to allow insertion of a card therein;

wherein the two plates each have a length that is substantially equal to or greater than the length of the card and a width that is substantially equal to or greater than the width of the card;

wherein the bottom element includes a pair of longitudinal rims defining guidance grooves configured to mate with the rectangular plate of the lid element; and wherein the lid element includes a transverse rim at a rear side thereof that extends downwardly toward the bottom element so as to bridge the narrow space between the bottom element and the lid element, whereby, upon movement of the lid element relative to the bottom element, the transverse rim pushes the card along with the lid element over a limited travel distance, whose amplitude is substantially less than the length of the card.

2. The case of claim 1, wherein the longitudinal rims of the bottom element have a C-shaped cross-section.

3. The case of claim 1, wherein the guidance grooves have recessed portions and the lid element has tabs projecting therefrom, the tabs configured to correspond to the recessed portions so as to limit the motion of the lid element with respect to the bottom element.

4. The case of claim 3, wherein the tabs are elastically deformable with respect to the lid element such that the tabs maintain the lid element in a restricted position relative to the recessed portions when extended, and allow movement of the lid element beyond the recessed portions when compressed.

5. The case of claim 1, wherein the lid element is corrugated in a transverse direction such that the surface of the element is separated from the surface of the card at its central zone and in two lateral zones.

6. The case of claim 1, wherein the lid element defines a recess along the front side thereof.

7. The case of claim 1, further comprising a closure bar adapted to be attached to the front edge of the bottom element so as to prevent movement of the lid element and the card relative to the bottom element.

8. The case of claim 7, wherein the interface of the closure bar and the card defines an opening configured to connect to an attachment device.

9. The case of claim 7, wherein the closure bar includes locking tabs and the bottom element defines locking cavities that correspond to and are configured to engage the locking tabs of the closure bar.

10. The case of claim 1, wherein the lid element further includes spigots protruding from the edges thereof and configured for rigid attachment to the bottom element.

11. The case of claim 10, wherein the bottom element defines locking cavities that correspond to and are configured to engage the spigots of the lid element.

* * * * *